US007887056B2

(12) United States Patent
Tenorio

(10) Patent No.: US 7,887,056 B2
(45) Date of Patent: Feb. 15, 2011

(54) PUZZLE FORMED BY A PLURALITY OF CUBES

(75) Inventor: Jose Maxenchs Tenorio, Barcelona (ES)

(73) Assignee: Educocio S.L., Barcelona (ES)

( * ) Notice: Subject to any disclaimer, the term of this patent is extended or adjusted under 35 U.S.C. 154(b) by 61 days.

(21) Appl. No.: 12/440,962

(22) PCT Filed: Sep. 20, 2007

(86) PCT No.: PCT/ES2007/000531

§ 371 (c)(1),
(2), (4) Date: Mar. 12, 2009

(87) PCT Pub. No.: WO2008/092966

PCT Pub. Date: Aug. 7, 2008

(65) Prior Publication Data

US 2010/0038850 A1 Feb. 18, 2010

(30) Foreign Application Priority Data

Feb. 2, 2007 (ES) ..... 200700285

(51) Int. Cl.
*A63F 9/08* (2006.01)
*A63H 33/04* (2006.01)

(52) U.S. Cl. ..... 273/156; 446/92; 446/138

(58) Field of Classification Search ..... 273/157 R, 273/156, 155; 446/92, 135, 137, 138, 131
See application file for complete search history.

(56) References Cited

U.S. PATENT DOCUMENTS 2,570,625 A * 10/1951 Zimmerman et al. ..... 446/92
2,795,893 A * 6/1957 Vayo ..... 446/92
2,939,243 A 6/1960 Duggar
3,184,882 A * 5/1965 Vega ..... 446/92
3,254,440 A * 6/1966 Duggar ..... 446/92
3,601,921 A * 8/1971 Strohmaier ..... 446/92
3,655,201 A * 4/1972 Nichols ..... 273/153 R
5,409,236 A * 4/1995 Therrien ..... 273/156
5,746,638 A * 5/1998 Shiraishi ..... 446/92
6,241,249 B1 * 6/2001 Wang ..... 273/156
6,749,480 B1 * 6/2004 Hunts ..... 446/92
7,160,170 B2 * 1/2007 Yoon ..... 446/92
7,320,633 B2 * 1/2008 Park ..... 446/92
7,322,873 B2 * 1/2008 Rosen et al. ..... 446/91

(Continued)

FOREIGN PATENT DOCUMENTS

BE 888110 1/1981

(Continued)

*Primary Examiner*—Steven Wong
(74) *Attorney, Agent, or Firm*—Sturm & Fix LLP

(57) ABSTRACT

Puzzle formed by a plurality of cubes. Puzzle formed by a plurality of cubes, wherein each face (3) of each cube shows a fragment of an image, and which is formed by a quantity of cubes whose square root is a whole number. The cubes may be arranged three-dimensionally forming a bigger cube in such a way that each of the faces of the bigger cube shows an image formed by the fragments of images of each of the seen faces (3) of each of the cubes. Each of the cubes can have reversible connecting means for connecting the cube with cubes adjacent thereto preferably by means of movable magnets. The puzzle can be used as a flags construction game.

4 Claims, 7 Drawing Sheets

U.S. PATENT DOCUMENTS

| | | | | |
|---|---|---|---|---|
| 7,413,493 | B2 * | 8/2008 | Toht et al. | 446/92 |
| 2006/0111010 | A1 * | 5/2006 | Park | 446/92 |
| 2010/0087119 | A1 * | 4/2010 | Vicentelli | 446/92 |

FOREIGN PATENT DOCUMENTS

| | | |
|---|---|---|
| EP | 0051576 | 5/1982 |
| ES | 263451 | 7/1983 |
| ES | 266515 | 7/1983 |
| ES | 290808 | 6/1986 |
| ES | 2133234 | 9/1999 |
| FR | 2517979 | 6/1983 |
| GB | 2307866 | 6/1997 |
| WO | 2005118093 | 12/2005 |

* cited by examiner

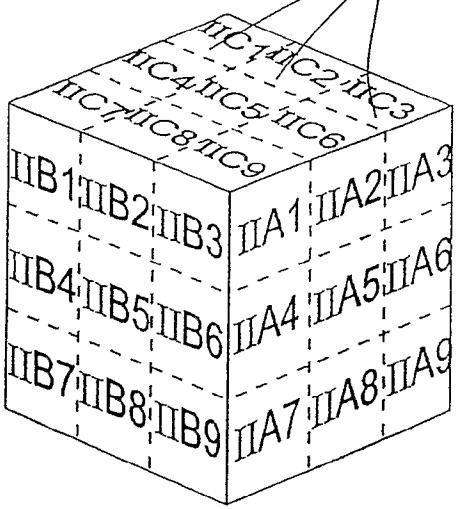
FIG. 1a
FIG. 1b
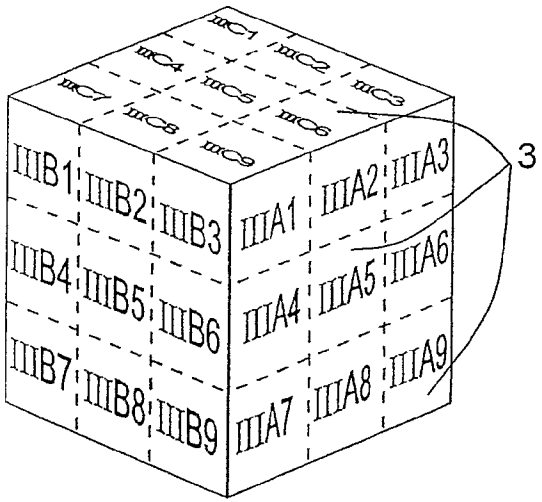
FIG. 1c

PUZZLE FORMED BY A PLURALITY OF CUBES

FIELD OF THE INVENTION

The invention refers to a puzzle made up from a plurality of cubes or hexahedrons, wherein each face of the cube shows a fragment of the image.

STATE OF THE ART

The puzzles of the type stated at the beginning are already known. Suitably placing the cubes in rows and in columns onto a flat surface, an image is obtained from the fragments of the image presented on the upper faces of the cubes. However, it is possible to suitably relocate the cubes in such a way that a second different image from the first is obtained, from the image fragments presented on other faces of the cubes. It is possible to form a total of six different images from the six image fragments that each cube has on its faces.

SUMMARY OF THE INVENTION

The object of the invention is a new puzzle. This end is achieved by means of a puzzle of the type stated at the beginning and is characterised because it is made up of a quantity of cubes whose cube root is a whole number and because the cubes are suitable for arranging three dimensionally forming a bigger cube in such a way that each one of the faces of the bigger cube shows an image made up by the images fragments of each one of the visible faces of each one of the cubes.

Thus, the bigger cube will have three dimensions (height, width and depth) made up from a specific number of cubes. Each dimension will have the same number of cubes. Therefore, the bigger cube will have a quantity of cubes that will be a whole number raised to the cube ($2^3$, $3^3$, $4^3$, etc.). Therefore, the total amount of cubes of the puzzle will be a number whose cubic root is a whole number (8, 27, 64, etc.). Preferably, the puzzle will have 8, 27 or 64 cubes and the most preferable will be with 27 cubes, as these are the most suitable quantities to make a puzzle with an achievable difficulty.

The bigger cube can be made in many different shapes. For example, if the bigger cube is made up of 27 cubes, the bigger cube can show 18 different images, in such a way that, once completely constructed, the bigger cube shows 6 simultaneous complete images, one of each of the faces of the bigger cube. If the bigger cube is made up of 64 cubes, the bigger cube can show 24 different images. In this way this puzzle has some difficulty and a greater attraction than the conventional puzzle cubes.

Advantageously each one of the cubes has some reversible attachment means that allows the joining of the cube to the adjacent cubes. In this way, once the puzzle has been put together, it can be moved or handled easily without the risk of it coming apart. Likewise it is a help to prevent it coming apart during the assembly of same.

Preferably the reversible attachment means are magnets. The magnets have the advantage that they create a 'remote' attachment force. This means, the magnets can be housed on the inner of the cubes and, in spite of this, an attraction force is exercised between the cubes. In this way the external aspect of the cubes is not altered by the presence of the reversible attachment means, as these (i.e. the magnets) are housed on the inner of the cubes. Also the magnets can be put on the external surface of the cubes; however this would affect the external aspect of same.

Advantageously each cube has at least a first magnet on the inner with its axis against one of its faces, wherein the first magnet is joined to the cube by some fixing means that have movement means so that they are suitable to move the magnetic axis in regard to the corresponding face, in such a way that any face of any cube can face any face of any cube, both faces being held to each other by the action of the forces of attraction of the respective magnets. As it is well known, magnets have the disadvantage that they have a specific polarity and can only exercise an attraction force between two magnets when the north pole of one is facing the south pole of the other. In the opposite a force of repulsion is exercised. If one wants to guarantee that any face of any cube can join any face of any other cube, it must be possible to orientate the magnets in each case in a suitable manner so that an attraction force is exercised between them. Preferably, this orientation must be made in an automatic manner, this means, without the need for the user to carry out any specific action. In this sense, the movement means are activated by the attraction force and repulsion itself between the magnets. If two faces of two cubes are facing each other in which the respective magnets have the same orientation of the magnetic poles, a repulsion force will be generated that will tend to separate them. The means for the movement will be activated by these repulsion forces in such a way that the two magnets change their relative position in the space. This will allow the two magnets to move to a new relative position in which an attraction force is exercised between both cubes.

There are differing forms of designing the movement means. Next, a description of some of them is given by means of the figures, without this excluding the possibility of there being others.

Likewise the object of the invention is a game for the construction of flags, characterised in that it includes a puzzle according to the invention. As has been said previously, the puzzle according to the invention can show a plurality of images. However, the flags are a very special type of image. Many of them are made up of strips of colour and, in addition, the colours of the strips are usually common for different flags (such as black, white, etc.). This means that the same face of a cube, for example, be it black, can simultaneously be used to make more than one flag. A suitable selection of flags therefore allows the puzzle to be capable of reproducing a large number of flags. Along these lines, one preferred solution is that of a flag construction game that includes a puzzle with 27 cubes and that is capable of making images of at least 54 flags.

BRIEF DESCRIPTION OF THE DRAWINGS

Other advantages and characteristics of the invention can be appreciated from the followings description, in which, without being in any way a limitation, some preferred ways of embodying the invention are described, making mention of the drawings which are attached. The figures show:

FIGS. 1*a*, 1*b* and 1*c*, some views in perspective of a puzzle according to the invention FIGS. 2, 3, 4 and 5, some diagrammatic views of some longitudinal sections of some cubes with four preferred forms of embodying the fixing means according to the invention.

DETAILED DESCRIPTION OF SOME FORMS OF EMBODYING THE INVENTION

FIGS. 1*a*, 1*b* and 1*c* show a specific shape of the embodiment of a puzzle according to the invention. The puzzle is made up of 27 cubes that can be grouped together making up a bigger cube of 3×3×3 cubes. Each face 3 of each one of the cubes has been identified by means of a three digit number and letter code, XYZ. The X corresponds to the alternative of the bigger assembled cubes: Three bigger cubes identified as I, II and III can be assembled. The Y corresponds to the face of the bigger cube. The bigger cube has six faces identified as A, B, C, D, E and F. The Z corresponds to the position of the face of the cube in respect of the face of the bigger cube, each face of the bigger cube is made up of nine new faces of nine cubes, identified as 1, 2, 3, 4, 5, 6, 7, 8 and 9.

Figure 2:
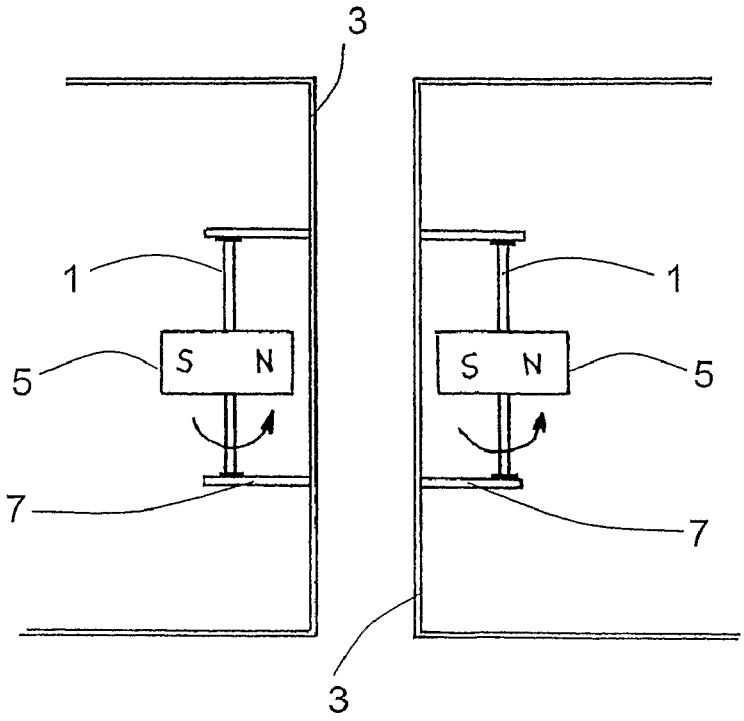

FIG. 2 shows a first way of an embodiment of movement means, which is characterised in that it has a rotation axis 1 parallel to face 3 and the first magnet 5 is connected to the rotation axis 1. In this case the movement is a simple turning round of the first magnet 5 turning perpendicularly to its magnetic axis. The first magnet 5 is joined to the cube by means of some fixing means 7.

Figure 3:
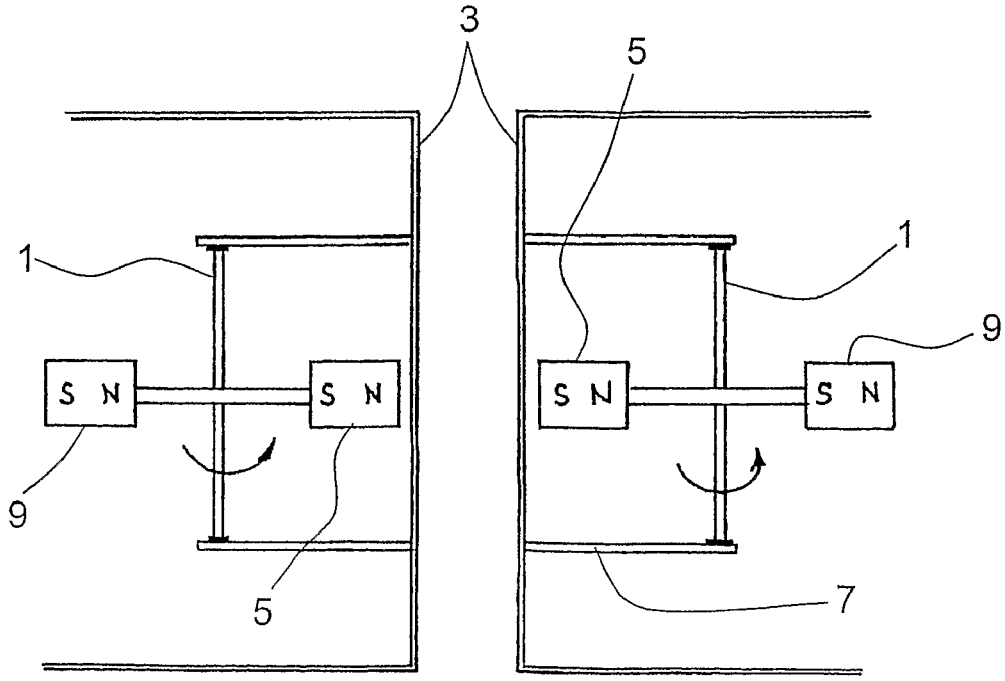

FIG. 3 shows a second form of an embodiment with movement means, which is a variation of the embodiment in FIG. 2 and is characterised in that it has a second magnet 9 connected to the rotation axis 1 parallel to face 3, wherein the second magnet 9 has its polarity reversed compared to the first magnet 5 and is angularly moved, in the direction of the rotation axis 1, compared to the first magnet 5. Specifically, in the example of FIG. 3 the first magnet 5 and the second magnet 9 are arranged at a 180° angle to the rotation axis 1, this means diametrically opposed to the rotation axis 1. The workings are identical to the movement means in FIG. 2, with the difference being that instead of having a single magnet more or less elongated there can be two shorter magnets, but maintaining a pair of raised forces compared to the rotation axis 1. When two cubes come towards each other, if the magnets do not have a suitable polarity, a force of repulsion is generated between them which makes them turn on their rotation axis 1 parallel to face 3 until two magnets are facing each other with a suitable polarity. The other magnet stays on the inner of the cube; sufficiently far away from any other magnet in such a way that it does not exercise or suffer from any significantly increased force.

Figure 4:
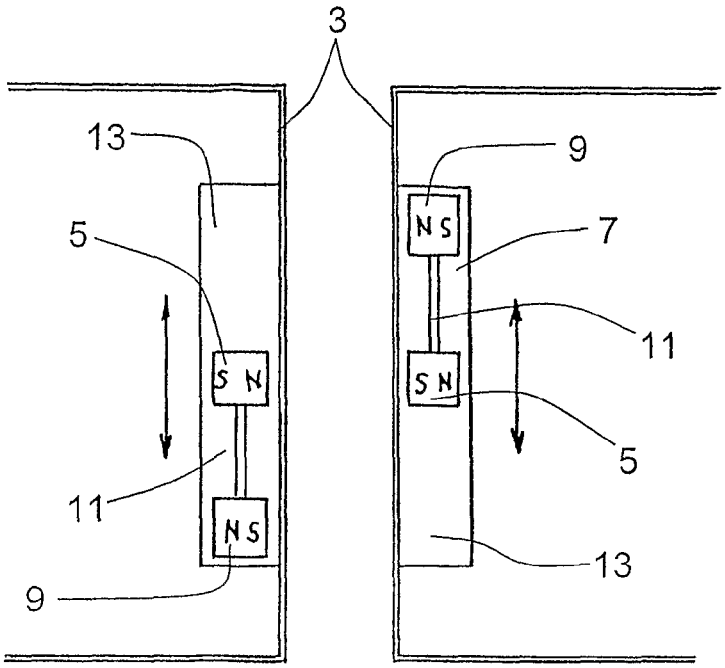

FIG. 4 shows another example of an embodiment of the movement means. This case is characterised in that there are: [a] a rod 11, that makes a longitudinal axis parallel to the face 3, with the first magnet 5 fitted at one of its ends and a second magnet 9 fitted at the opposite end, wherein the first and the second magnets 5 and 9 have their polarity reversed one to the other, and [b] a housing 13 elongated along the longitudinal axis, wherein the housing 13 is of such a size so that it can be housed on the inner of the rod 11 and is suitable so that it will allow the rod 11 to move on the longitudinal axis along the length of the housing 13. In this case, if the two magnets face each other and do not have the right polarity, a repulsion force is generated that forces them to move along the housing 13. In the solution shown in FIG. 4, it will therefore be able to have two different situations. If the two cubes that come towards each other are exactly as shown in the FIG. 4, the attraction will be exercised between the two magnets that are in the middle of the respective faces 3, whilst the magnets that are at both ends will not provide any force for the joining between the two cubes. If, however, one of the cubes is turned in the reverse direction as shown in FIG. 4 (this means, with the magnet that is at the upper end of housing 13, according to the figure, put in the bottom end), then it will be able to exercise an attraction force between the four magnets, two to two. In this case the attraction force will have to be greater or lesser in line with the relative position of both cubes. It must be highlighted that the housings 13 do not have to be parallel, as they could also be perpendicular to each other.

Figure 5:
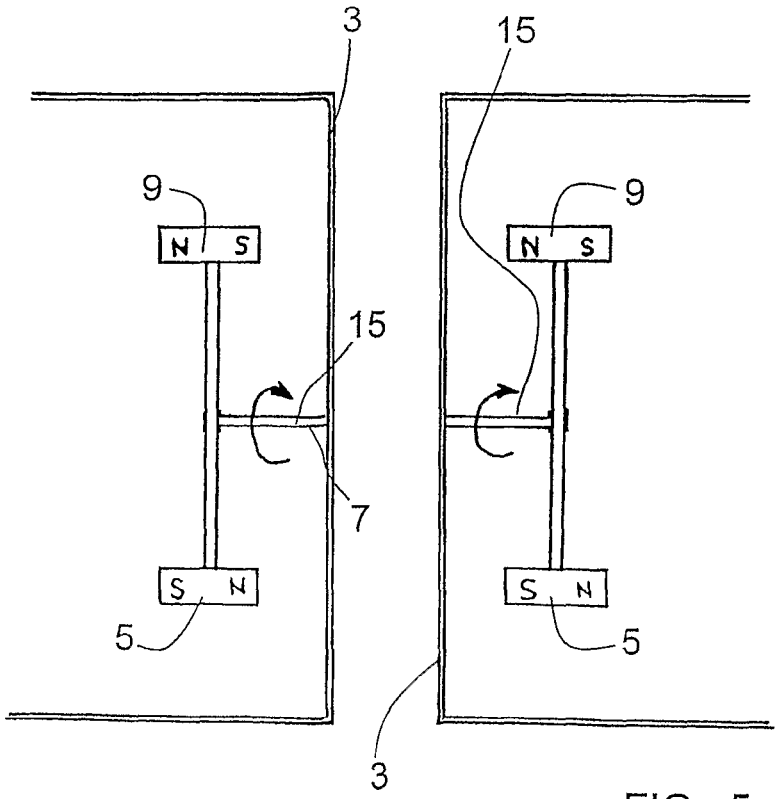

Finally, in FIG. 5 another form of embodiment is shown of the movement means. In this case the movement means have a rotation axis 15 perpendicular to face 3 and include a first magnet 5 and a second magnet 9 that have their magnetic axes parallel to each other and one has the polarity reversed to the other, wherein both magnets 5 and 9 are angularly moved against each other in the direction of the rotation axis 15 perpendicular to face 3, and wherein the magnets 5 and 9 are moved by means of a turn on the axis 15 perpendicular to face 3. The two magnets 5 and 9 could be arranged in an asymmetrical manner compared to the rotation axis 15 perpendicular to face 3. They could be in a manner that is not diametrically opposed; they could be angularly moved through 180° but at a different distance from the rotation axis 15 perpendicular to face 3, etc. However, by preference the rotation axis 15 perpendicular to face 3 is at a mid-point between both magnetic axes.

In the examples shown in FIGS. 3 and 5 other solutions are possible with more magnets, for example with 4 magnets distributed in a cross around the rotation axis 1 or 15 respectively.

Figure 6:
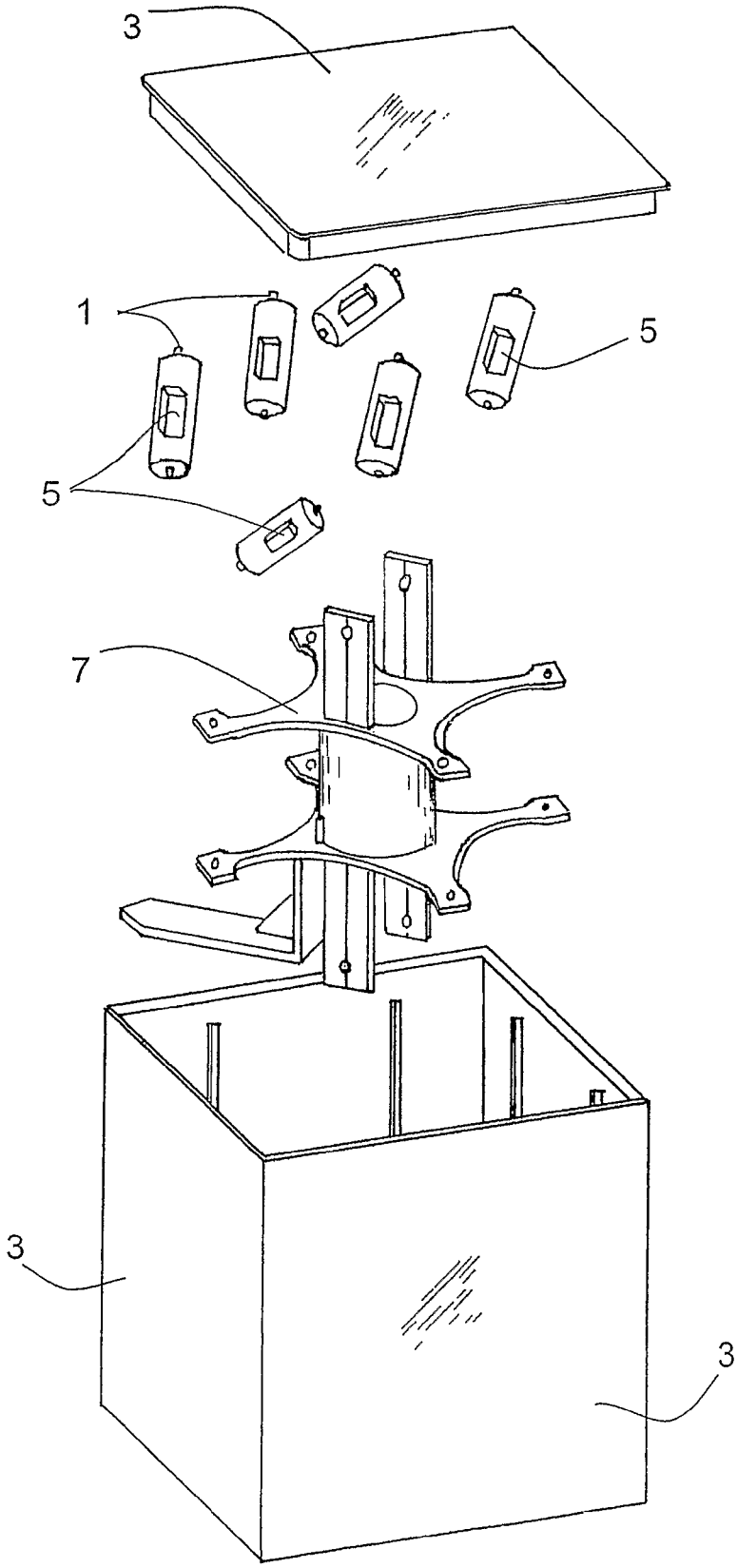
FIG. 6, some exploded perspective views of a cube with a preferred structure for the specific embodiment of some fixing means like those in FIG. 2.
Figure 7:
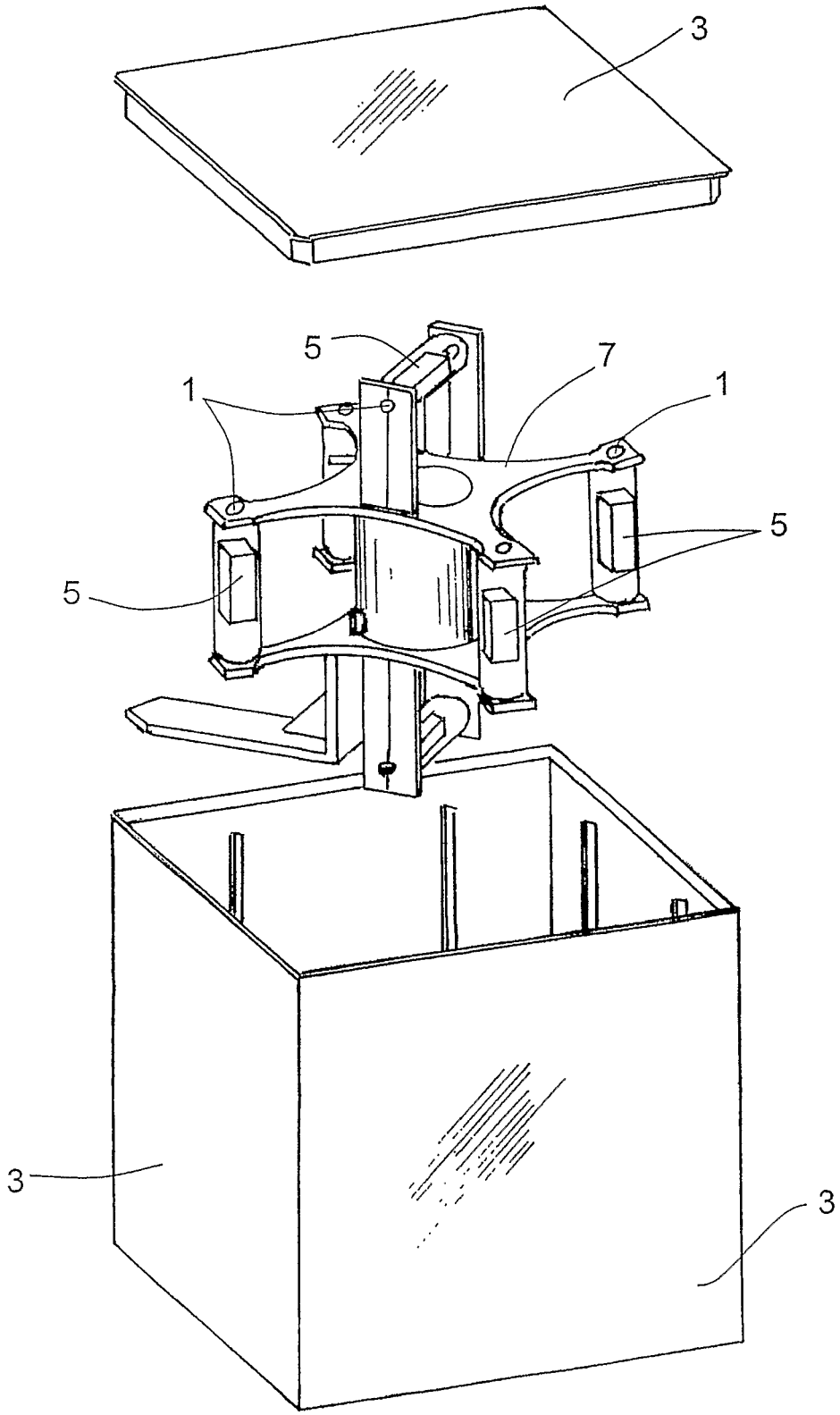
FIG. 7, the view of FIG. 6 with the fixing means pre-assembled.
Figure 8:
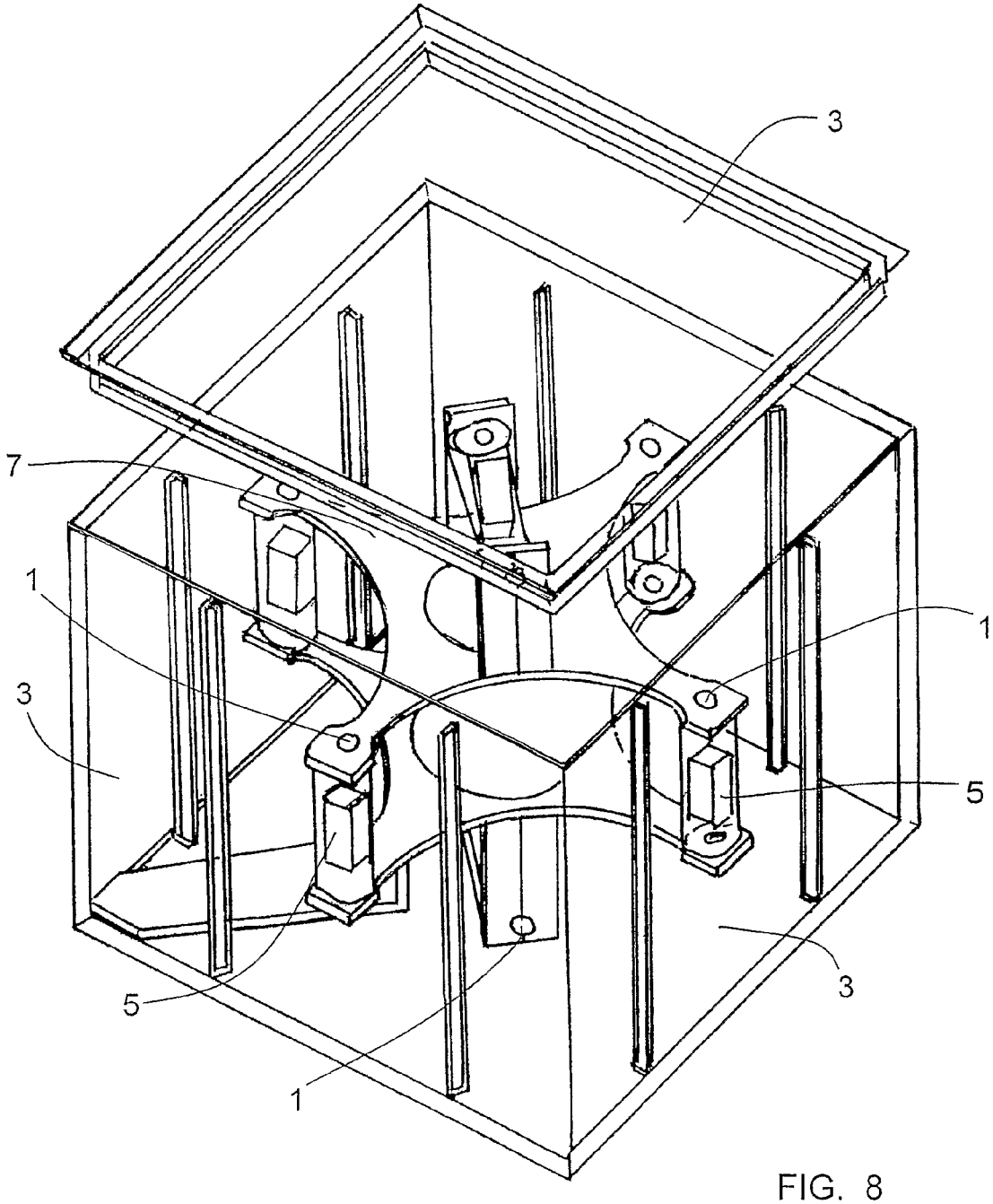
FIG. 8, the view of FIG. 7, with the fixing means housed on the inner of the cube.

In FIGS. 6 to 8 detailed a practical embodiment is shown of a cube with movement means as shown diagrammatically in FIG. 2. The cube has a magnet (a first magnet 5, in accordance with the nomenclature used) on each one of the faces 3. Therefore, the cube can connect with any other cube with any of its faces. In particular it can make the bigger cube which is the object of this invention with the peculiarity that it allows any order of assembly, this means, it can be assembled both if the relative position between the cubes is the correct one to form any image or equally if it is wrong. Therefore, the reversible connection means are independent from the game in itself (to position the cubes in the order that is appropriate to obtain the images) and do not give any type of clue or guidance as to which is the correct order for the assembly of the cubes. The reversible connection means are limited to maintaining the cubes connected to each other as and how positioned by the user.

Figure 9:
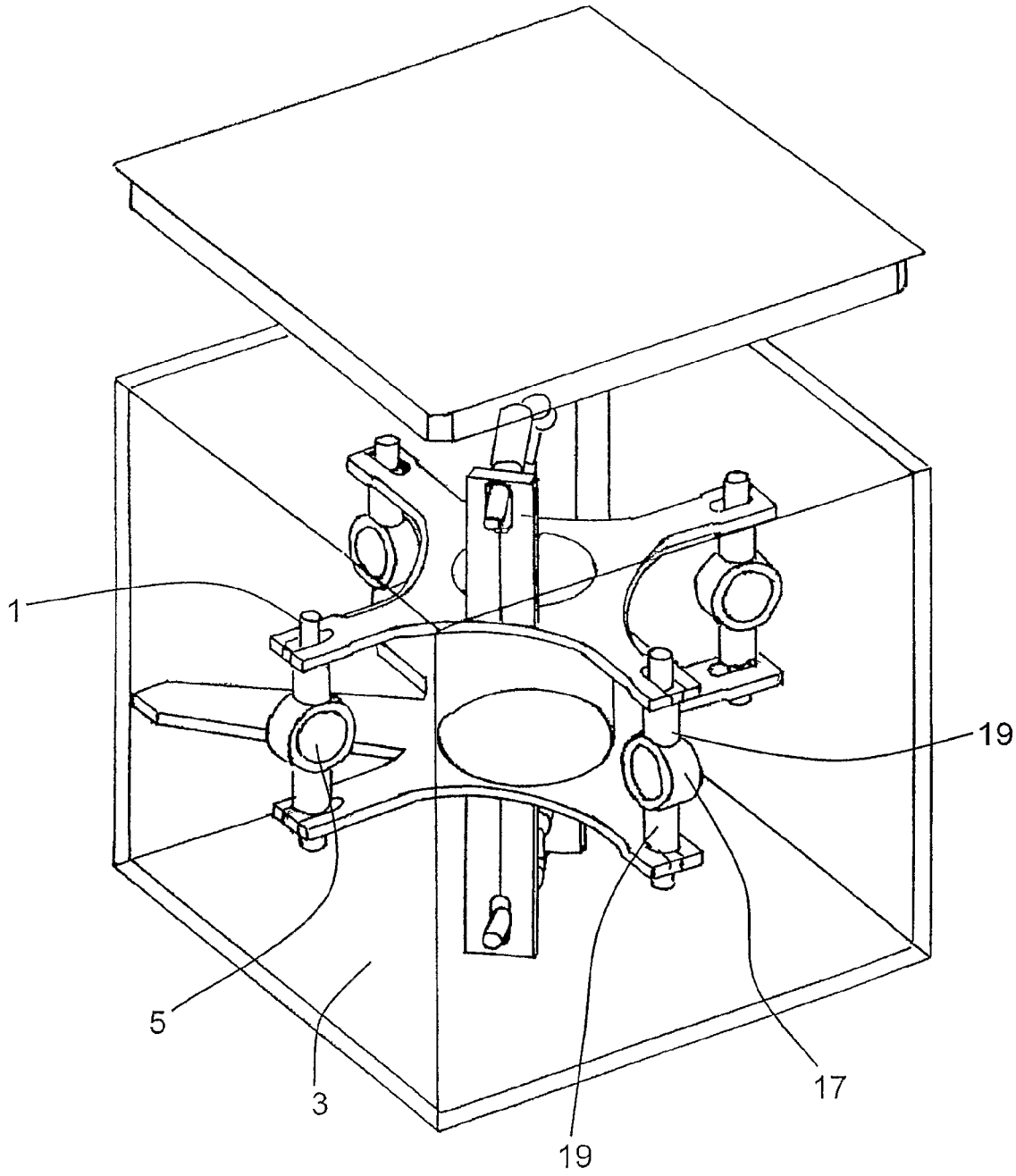
FIG. 9, a perspective view of a cube with another preferred structure for the embodiment of some fixing means like those in FIG. 2.

In FIG. 9, a variation of the movement means is shown that includes a cylindrical bushing 17 that forms a cylindrical housing inside of which magnet 5 is housed (the first magnet 5, in accordance with the nomenclature used). Two rods 19 are projected from the cylindrical bushing 17 that are radially and opposing each other, that have a first section joined to the bushing 17, with a greater diameter and a second section, at the free end, with a smaller diameter, in such a way that both ends are adapted so as to allow them to be housed in some openings made in the movement means, wherein these openings define the rotation axis 1 parallel to face 3.

The invention claimed is:

1. A puzzle comprising a plurality of cubes, including shown faces and inner faces whose cube root is a whole number suitable for arranging three dimensionally, making up a bigger cube in such a way that each one of the faces of the bigger cube shows an image made up of image fragments from each one of the shown faces of each one of the cubes, each cube being provided with at least a first magnet on an inner face with its magnetic axes on each one of the faces, said first magnet joined to said cube by fixing means that has movement means that are suitable for moving the said magnetic axis against the corresponding face in such a way that said face of any cube can face any other face of any other cube, both faces being joined to each other by the attraction forces of the respective magnets, and said movement means has a rotation axis and said first magnet is joined to said rotation axis; and wherein the rotational axis is disposed parallel to said face, and further including a second magnet connected to said rotation axis parallel to said face, said second magnet having its polarity reversed with respect to the said first magnet, and is angularly moved in the direction of said rotation axis parallel to said face with respect to said first magnet.

2. A puzzle comprising a plurality of cubes, including shown faces and inner faces whose cube root is a whole number suitable for arranging three dimensionally, making up a bigger cube in such a way that each one of the faces of the bigger cube shows an image made up of image fragments from each one of the shown faces of each one of the cubes, each cube being provided with at least a first magnet on an inner face with its magnetic axes on each one of the faces, said first magnet joined to said cube by fixing means that has movement means that are suitable for moving the said magnetic axis against the corresponding face in such a way that said face of any cube can face any other face of any other cube, both faces being joined to each other by the attraction forces of the respective magnets, and said movement means has a rotation axis and said first magnet is joined to said rotation axis; and wherein the rotational axis is disposed perpendicular to said face, and said movement means having: [a] a rod, that defines a longitudinal axis parallel to said face, with said first magnet fitted at one of its ends and a second magnet fitted at the opposite end, said first and second magnet having their polarity reversed with respect to the other, and [b] a housing elongated along said longitudinal axis, said housing being of such a size that it is suitable to house said rod on an inner face and is suitable to move said rod on said longitudinal axis along said housing.

3. A puzzle comprising a plurality of cubes, including shown faces and inner faces whose cube root is a whole number suitable for arranging three dimensionally, making up a bigger cube in such a way that each one of the faces of the bigger cube shows an image made up of image fragments from each one of the shown faces of each one of the cubes, each cube being provided with at least a first magnet on an inner face with its magnetic axes on each one of the faces, said first magnet joined to said cube by fixing means that has movement means that are suitable for moving the said magnetic axis against the corresponding face in such a way that said face of any cube can face any other face of any other cube, both faces being joined to each other by the attraction forces of the respective magnets, and said movement means has a rotation axis and said first magnet is joined to said rotation axis; and wherein the rotational axis is disposed perpendicular to said face, and said movement means having a rotation axis that is perpendicular to said face and comprises said first magnet and a second magnet having their magnetic axes parallel to each other and each one has the polarities reversed with respect to the other, said first and second magnets being angularly moved from one to the other in the direction of said rotation axis perpendicular to said face, and said first and second magnets being moved by rotation on said rotation axis perpendicular to said face.

4. Puzzle according to claim 3, further comprising said rotation axis perpendicular to said face being at a mid point between said magnetic axes.

* * * * *